United States Patent [19]

Franke et al.

[11] Patent Number: 4,657,836

[45] Date of Patent: Apr. 14, 1987

[54] ELECTROPHOTOGRAPHIC MATERIAL SENSITIZED BY 3,3'-DIMETHYLINDOLENINE CYANINE DYES

[75] Inventors: Werner Franke, Wiesbaden; Richard Brahm, Ingelheim, both of Fed. Rep. of Germany

[73] Assignee: Hoechst Aktiengesellschaft, Frankfurt am Main, Fed. Rep. of Germany

[21] Appl. No.: 836,419

[22] Filed: Mar. 5, 1986

[30] Foreign Application Priority Data

Mar. 14, 1985 [DE] Fed. Rep. of Germany ..... 3509147

[51] Int. Cl.[4] ..... G03G 5/09

[52] U.S. Cl. ..... 430/83; 430/93; 430/95

[58] Field of Search ..... 430/83, 93, 95

[56] References Cited

U.S. PATENT DOCUMENTS

| | | | |
|---|---|---|---|
| 3,112,197 | 11/1963 | Neugebauer et al. | 96/1 |
| 3,180,729 | 4/1965 | Klupfel et al. | 96/1 |
| 3,189,447 | 6/1965 | Neugebauer et al. | 96/1 |
| 3,257,203 | 6/1966 | Sues et al. | 96/1.5 |
| 3,458,310 | 7/1969 | Arneth et al. | 96/1.2 |
| 3,660,086 | 5/1972 | Tamai et al. | 430/95 X |
| 3,881,926 | 5/1975 | Ohlschlager et al. | 430/93 X |
| 3,992,205 | 11/1976 | Wiedemann | 96/1.6 |
| 4,063,948 | 12/1977 | Lind | 96/1.6 |
| 4,066,453 | 1/1978 | Lind et al. | 96/1 R |
| 4,153,461 | 5/1979 | Berghaeuser et al. | 96/75 |
| 4,252,880 | 2/1981 | Lind et al. | 430/82 |
| 4,278,747 | 7/1981 | Murayama et al. | 430/82 |
| 4,565,757 | 1/1986 | Chalk et al. | 430/83 |

FOREIGN PATENT DOCUMENTS

| | | | |
|---|---|---|---|
| 2526720 | 12/1976 | Fed. Rep. of Germany | 430/83 |

*Primary Examiner*—Roland E. Martin

*Attorney, Agent, or Firm*—Schwartz, Jeffery, Schwaab, Mack, Blumenthal & Evans

[57] ABSTRACT

In an electrophotographic recording material comprising an electrically conductive base material and at least one photoconductive layer containing a photoconductor, a binder and at least three sensitizing dyes of which at least two are 3,3'-dimethylindolenine compounds, such as bis-(3,3'-dimethylindolenyl)-trimethinecyanines and -pentamethinecyanines, having a sensitizing action in different wavelength regions, it is possible to sensitize various organic and inorganic photoconductors within the range from about 400 to 700 nm.

24 Claims, 3 Drawing Figures

ELECTROPHOTOGRAPHIC MATERIAL SENSITIZED BY 3,3'-DIMETHYLINDOLENINE CYANINE DYES

BACKGROUND OF THE INVENTION

The present invention relates to an electrophotographic recording material comprising an electrically conductive base material and at least one photoconductive layer containing a photoconductor and 3,3'-dimethylindolenine sensitizing dyes.

In electrophotographic reproduction, it is known to use photoconductors that are sensitive to radiation in the short-wave visible portion of the spectrum. It is also known that the radiation-sensitivity of such photoconductors in the visible portion of the spectrum can be extended by addition of one or more sensitizing dyes capable of transferring the energy of longer-wave light to the photoconductor. Various classes of dye compounds can be used for sensitization of photoconductors in this manner.

It is known (see German Auslegeschrift No. 2,526,720, corresponding to U.S. Pat. No. 4,063,948) to use in electrophotographic reproduction an electrophotographic recording material that contains, in the photoconductive layer, a cyanine dye which has a sensitizing action in the blue spectrum. However, such a sensitizing action does not make it possible also to record, for example, radiation in the green and red parts of the spectrum.

It is also known (see German Offenlegungsschrift No. 1,447,907, corresponding to U.S. Pat. No. 3,458,310) to sensitize photoconductor layers to the visible red portion of the spectrum. This is done by using, for example, mixtures of acridine yellow, acridine orange, rhodamine dye and brilliant green which are added in one layer or separately, in different layers (see German Offenlegungsschrift No. 2,353,639, corresponding to U.S. Pat. No. 3,992,205), when the respective sensitization actions of individual dyes are added together or, alternatively, the resultant actions are different (see German Offenlegungsschrift No. 2,817,428, corresponding to U.S. Pat. No. 4,252,880).

Such panchromatic sensitizations provide advantages to the extent that high-red light sources used in reproduction technology are better utilized. In practice this means shorter exposure times and, hence, time and energy savings. Due to improved sensitivity, it is also possible to reduce the photoconductor content in the photoconductive layer.

Since one sensitizer alone generally does not cover the entire visible spectrum, it is necessary to mix more than one sensitizer. But it is very difficult thereby to obtain sensitizations that meet the varied requirements of the reproduction industry. Different sensitizers, with differing chemical as well as absorptive properties, must nevertheless be soluble in the solvent used and in the binding agent of the photoconductive layer. Different sensitizers used in a mixture may also influence each other in such a way as to affect adversely the sensitizing properties of the mix.

SUMMARY OF THE INVENTION

With the present invention, however, electrophotographic recording material comprising organic or inorganic photoconductor can be sensitized for the spectral region covering the area of self-sensitivity of the photoconductor up to above approximately 700 nm, ideally by overlapping of individual sensitization spectra of the sensitizing dyes. The resulting sensitization conforms to the emission of a light source, such as a mercury-gallium lamp, that emits in the entire visible region, but the sensitization also has sensitization maxima which are within the region of the emission of customary lasers, such as argon ion lasers and krypton lasers, and LED diodes.

Thus, it is an object of the present invention to provide electrophotographic recording material comprising a mixture of dyes that sensitizes the recording material to virtually the entire visible spectrum without preventing the recording material from meeting the above-discussed requirements of contemporary reproduction.

It is also an object of the present invention to provide a sensitization mixture, for use in electrophotographic recording material, that is comprised of dyes which have different absorption ranges but which are derived from the same heterocycle of cyanine dye systems and, hence, are fully compatible.

In accomplishing the foregoing objects, there has been provided, in accordance with one aspect of the present invention, an electrophotographic recording material comprising an electrically conductive base material and at least one photoconductive layer containing a photoconductor, a binder and at least three sensitizing dyes, at least two of the dyes being 3,3'-dimethylindolenines with a sensitizing action in differing wavelength regions, respectively. In preferred embodiments of the present invention, the photoconductive layer comprises a bis-(3,3'-dimethylindolenyl)-trimethinecyanine sensitizing dye and a bis-(3,3'-dimethylindolenyl)-pentamethinecyanine sensitizing dye.

In accordance with another aspect of the present invention, there has been provided a composition for sensitizing electrophotographic recording material, comprising an admixture of at least three sensitizing dyes, wherein at least two of the sensitizing dyes comprise 3,3'-dimethylindolenine compounds having a sensitizing action in differing wavelength regions, respectively.

Other objects, features and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

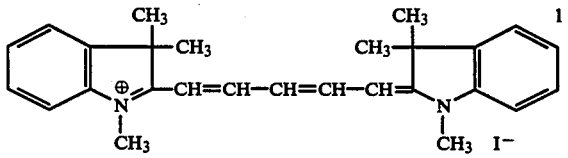

1

-continued

2

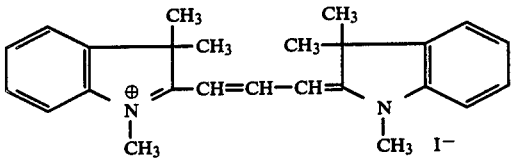

3

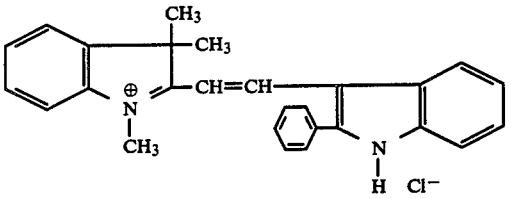

4

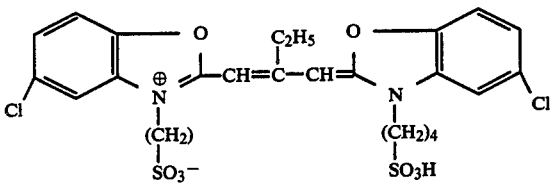

Figure 2:
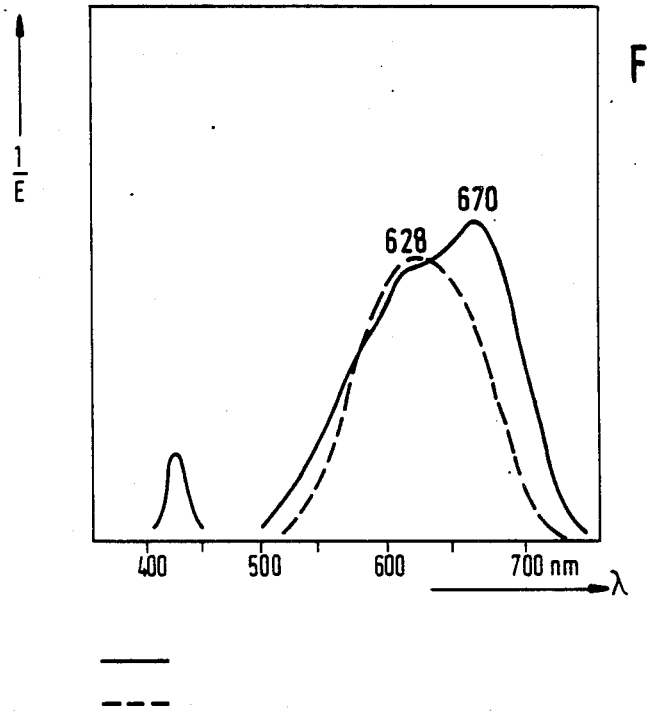

FIG. 2 is a graph comparing the sensitization spectra of a dye represented by formula (1) (solid line) and the dye "brilliant green" (broken line).

Figure 3:
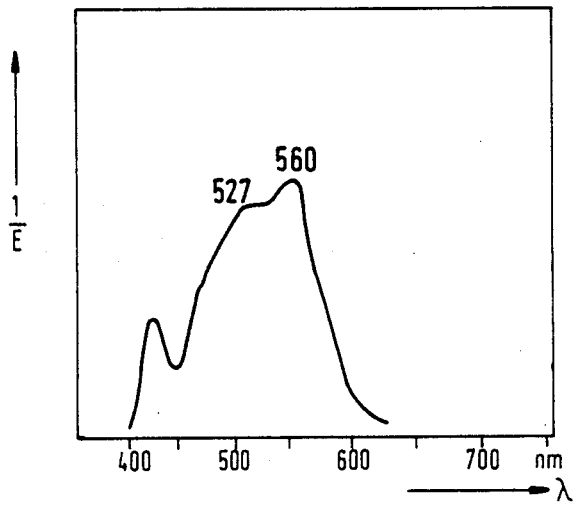

FIG. 3 is a graph depicting the sensitization spectrum of a dye represented by formula (2) above.

DETAILED DESCRIPTION OF PREFERRED EMBODIMENTS

In a preferred embodiment of the present invention, the sensitizing dyes of the 3,3'-dimethylindolenine type which are present are bis-(3,3'-dimethylindolenyl)-trimethinecyanines and -pentamethinecyanines, as represented, respectively, by formulas (1) and (2).

Additional sensitizing dyes which are preferably used, according to the present invention, with the aforesaid 3,3'-dimethylindolenine compounds are cyanine dyes from the group consisting of Astrazone Orange R (C.I. 48040, represented by formula (3), Astrazone Orange G (C.I. 48035), Astrazone Yellow 3G (C.I. 48055), Astrazone Yellow 5G (C.I. 48065) and Basic Yellow 52115 (C.I. 48060).

It has been found that sensitizing dyes have different activities for different types of photoconductor. For example, when inorganic photoconductors like zinc oxide are used then bis-benzoxazoletrimethinecyanines, represented by formula (4), are used to advantage as sensitizing dyes in the photoconductive layer also containing two or more 3,3'-dimethylindolenine dyes, in accordance with the present invention. Compounds represented by formula (4) are disclosed in German Patent Application No. P 34 05 487.1 as sensitizing dyes.

By judicious selection of the above-mentioned dyes, and by mixing them in an appropriate ratio as described in greater detail below, different organic or inorganic photoconductors can be efficiently sensitized, according to the present invention, within the range from about 400 to 700 nm.

The spectral sensitizing dye of the present invention which is represented by formula (1) is distinguished by intense sensitization in the red, with a sensitization maximum at 670 nm and a shoulder at 640 nm. The formula (1) dye is, for example, more intense and has a longer-wave sensitization than the customarily used brilliant green, as evidenced by FIG. 2.

The sensitizing dye represented by formula (2), which is preferably used in admixture with the sensitizing dye of formula (1), has a sensitizing action in the green, with a sensitizing maximum at 560 nm and a shoulder at about 500 nm.

FIG. 3 shows the spectral sensitization effected by the dye represented by formula (2). In contrast, the dye represented by formula (3) sensitizes in the blue region of the spectrum, with a maximum at around 500 nm, as depicted in FIG. 1.

Figure 1:
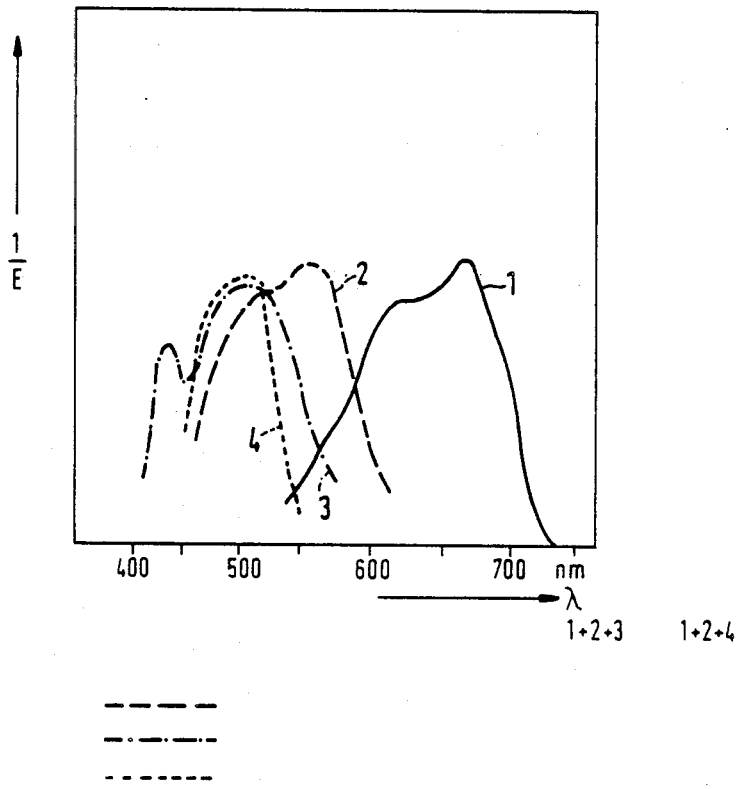
FIG. 1 is a graph showing the respective sensitization spectra for sensitizing dyes of the present invention, which dyes are represented by the following formulas.

The sensitization characteristics of dyes used in accordance with the present invention are generally evident from the accompanying spectrograms in FIGS. 1 through 3. Of these, FIG. 1 indicates the sensitization characteristics of the individual dyes in organic photoconductor layers in the range from 400 to about 700 nm. Mixtures of the dyes according to formulas (1), (2) and (3) for organic photoconductor layers and mixtures of the dyes according to formulas (1), (2) and (4) result in corresponding total sensitization characteristics.

Sensitizing dyes (1), (2) and (4) of the present invention can be prepared using methods well-known to those skilled in the chemistry of cyanine dyes. See, e.g., W. Koenig, B. 57,685 (1924); German Patent No. 410,487; A. Claisen, B. 36,3667 (1903) (B.=Reports of the German Chemical Society).

The concentration of the sensitizing dyes according to the present invention depends on the specific photoconductor used on the desired effect, and on the selection of sensitizing dyes. It is customary to add 0.05 to 1.0 percent by weight of individual dyes, based on the weight of the photoconductor. By changing the mixing ratio from, for example, 1:1:1 to 0.5:1:1 for sensitizing dyes (1), (2) and (4), respectively, it is possible to enhance the action of the sensitizing dye represented by formula (1).

The photoconductive layer can be present both in single- and in multi-layer arrangement, wherein charge carrier generation and charge transport are effected, respectively, either in the same layer or in separate layers.

Suitable photoconductors for use in the present invention include not only organic but also inorganic compounds. Monomeric as well as polymeric aromatic carbocyclic or heterocyclic compounds are among the suitable organic photoconductors.

Preference is given to the use of oxadiazole derivatives like 2,5-bis-(4'-diethylaminophenyl)-1,3,4-oxadiazole, as described in German Patent No. 1,058,836 (corresponding to U.S. Pat. No. 3,189,447) and of oxazole derivatives such as 2-vinyl-4-(2'-chlorophenyl)-5-(4'-diethylaminophenyl)-oxazole and 2-phenyl-4-(2'-chlorophenyl)-5-(4'-diethylaminophenyl)-oxazole, as described in German Patents No. 1,060,260 (corresponding to U.S. Pat. No. 3,112,197) and No. 1,120,875 (corresponding to U.S. Pat. No. 3,257,203).

Pyrazoline derivatives as disclosed by German Auslegeschrift No. 1,060,714 (corresponding to U.S. Pat. No. 3,180,729) and hydrazone compounds as known, for example, from German Offenlegungsschrift No. 2,919,791 (corresponding to U.S. Pat. No. 4,278,747) are also suitable photoconductors.

Vinylaromatic polymers like polyvinylanthracene, polyacenaphthylene, and corresponding copolymers exemplify the polymeric photoconductors that can be used in accordance with the present invention. Very highly suitable are poly-N-vinylcarbazole and copolymers of N-vinylcarbazole having an n-vinylcarbazole content of at least about 40 percent by weight.

Suitable binders are natural and synthetic resins known for flexibility, film-forming properties and adhesion. Their choice is governed not only by the film-forming and electrical properties but also, because of adhesion to the base material, by solubility properties. Exemplary binders suitable for use in the present invention thus include polyester resins, such as copolyesters of isophthalic and terephthalic acid with glycol; silicone resins, such as three-dimensionally crosslinked phenyl methyl siloxanes; and so-called reactive resins of the type known as DD Lacquer. Polycarbonate resins are likewise highly suitable.

Binders which are particularly suitable in the preferred use of recording material within the present invention, namely, in the production of printing forms, are those that are soluble in aqueous or alcoholic solvent systems, whether in the absence or presence of acid or alkali. Accordingly, suitable binders are high-molecular substances which carry alkalisolubilizing groups, such as acid anhydride, carboxyl, phenol, sulfo, sulfonamide or sulfonimide groups. Copolymers having anhydride groups are particularly suitable, since the dark conductivity of a photoconductive layer incorporating them is low, despite high alkali solubility, as a result of the absence of free acid groups. Styrene/-maleic anhydride copolymers or phenolic resins are particularly preferred, respectively, as binders in the present invention.

The preferred inorganic photoconductor for the present invention is zinc oxide. The particle size of the photoconductive zinc oxide used is about 0.1 to 15 μm. Suitable binders having a specific resistance of $10^7$ to $10^{14}$ Ω·cm are in this case polymeric or resinous binders, or mixtures thereof. Suitable for this purpose are polyurethane, polyester, polycarbonates, polystyrenes, chlorinated rubber, acrylic resins, alkyd resins, silicone resins and vinyl acetate copolymers like vinyl chloride acetate resin.

The photoconductive layer of the present invention which incorporates zinc oxide as photoconductor can contain between 50 and about 95 percent by weight of the photoconductive particles. A preferred weight ratio of binder to particles lies between 1:4 and 1:10.

The base materials of recording material within the present invention can be of sheetlike or cylindrical construction, and can consist of a conventional metal plate, metal foil, metallized paper (or papers), or film which has been coated with an electrically conductive plastics material.

It is possible, in conventional manner, to generate toner images on the recording material according to the present invention, but it is also possible to transfer either the charge image or toner image to an image-receiving material.

It is also possible to obtain, in a known manner, a printing form or a printed circuit by charging, imaging, developing and decoating of the photoconductor layer in the non-image areas, and (optionally) etching away the metal layer in the non-image areas.

The electrophotographic recording material of the present invention can contain, as typical additives in the photoconductive layer, a levelling agent, a plasticizer and (between base material and photoconductive layer) an adhesion promoter.

The following examples below are provided to illustrate the present invention in more detail:

EXAMPLE 1

The sensitizing dyes represented, respectively, by formulas (1), (2) and (3) were each added, in 0.04 g amounts, to a solution of 8 g of 2-vinyl-4-(2'-chlorophenyl-5-(4'-diethylaminophenyl)-oxazole and 18 g of a copolymer of styrene and maleic anhydride in a mixture of 90 g of methylglycol, 140 g of tetrahydrofuran and 40 g of 85 percent strength butyl acetate. The resulting solution was applied to an aluminum foil which had been electrochemically roughened, surface-anodized, and then pretreated with polyvinylphosphonic acid as described in German offenlegungsschrift No. 1,621,478 (corresponding to U.S. Pat. No. 4,153,461). Evaporation of the solvent left a layer which was light-sensitive within the range from about 420 to 730 nm. The sensitization spectrogram is depicted in FIG. 1.

The recording material produced in this fashion was used to prepare a printing form for offset printing in the following manner. The photoconductive layer was charged in the dark to −430 V by means of a corona, and was then exposed for eight seconds to a mercury-gallium lamp (5000 W M023-Sylvania) in a repro camera set to aperture 14. The resulting latent charge image was developed with a commercially available dry toner by means of a magnetic roll, and the toner image was fixed by heat. Removal of the photoconductive layer in the areas not covered with toner, using a solution obtained by dissolving 50 g of $Na_2SiO_3.9\ H_2O$ in 250 g of glycerol (86% strength) and diluting with 390 g of ethylene glycol and 310 g of methanol, left a planorgraphic printing form with which a high edition could be printed.

EXAMPLE 2

To an aluminized, 100 μm-thick polyester film was applied a solution comprised of 10 g of 2-phenyl-4-(2'-chlorophenyl)-5-(4'-diethylaminophenyl)-oxazole, 15 g of a copolymer of styrene and maleic anhydride having a softening point of 210° C., 116 g of tetrahydrofuran, 33 g of butyl acetate, 76 g of methylglycol, and 1.5 g of the sensitizing dyes represented by formulas (1), (2) and (3) in a ratio of 1:1:0.5. Evaporation of the solvent left a photoconductive layer, approximately 5 μm in thickness, that had a spectral sensitivity in the range from about 400 nm to about 730 nm.

After exposure to the light of metal halide lamps, development using an electrophotographic developer, and removal of the photoconductor layer in the non-image areas via the method described in German Patent No. 2,322,047 (corresponding to U.S. Pat. No. 4,066,453), the bared aluminum vapor-deposition layer was removed by treatment with 2N sodium hydroxide solution. A printed circuit was obtained in this way.

Similar results were obtained when the specified oxazole was replaced by 2,5-bis-(4'-diethylaminophenyl)-1,3,4-oxiazole as photoconductor.

EXAMPLE 3

A 100 μm-thick aluminum foil was provided with a photoconductive layer. The photoconductive layer was prepared as follows: 100 parts by weight of photoconductive zinc oxide were mixed together with 40 parts by weight of a 50 percent strength solution of a modified multipolymer of vinyl acetate in toluene. The mixture was ball-milled for about 3 hours and was then applied by means of a doctor blade to a paper base material in a dry layer weight of about 30 g/m$^2$. The sensitizing dyes represented by formulas (1), (2) and (4) had each been added beforehand to the solution, in a ratio of 1:1:1, to provide a 1.5 percent total concentration, based on the weight of the photoconductor.

The layer was charged by means of a corona (voltage 5 kV negative, distance 25 mm) and was imaged, using an argon ion laser within the power range 0.2 to 0.5 mW (nominal power of 50 mW, output power 15 mW) at a forward speed of 400 lines/cm, in a device typically used for producing printing forms. The layer was processed thereafter in a manner customary with ZnO printing plates.

What is claimed is:

1. An electrophotographic recording material comprising an electrically conductive base material and at least one photoconductive layer containing a photoconductor, a binder and at least three sensitizing dyes, wherein at least two of said sensitizing dyes comprise cyanine compounds containing 3,3'-dimethylindolenine moieties at each end of the cyanine chain and having a sensitizing action in the red and green wavelength regions, respectively.

2. A recording material as claimed in claim 1, wherein said photoconductive layer comprises a bis-(3,3'-dimethylindolenyl)-trimethinecyanine sensitizing dye and a bis-(3,3'-dimethylindolenyl)-pentamethinecyanine sensitizing dye.

3. A recording material as claimed in claim 1, wherein a third dye of said sensitizing dyes comprises a cyanine dye selected from the group consisting of Astrazone Orange R (C.I. 48040), Astrazone Orange G (C.I. 48035), Astrazone Yellow 3G (C.I. 48055), Astrazone Yellow 5G (C.I. 48065) and Basic Yellow 52115 (C.I. 48060).

4. A recording material as claimed in claim 1, wherein a third dye of said sensitizing dyes comprises a bis-benzoxazoletrimethinecyanine compound.

5. A recording material as claimed in claim 1, wherein said photoconductor is an organic compound.

6. A recording material as claimed in claim 5, wherein said photoconductor is selected from the group consisting of an oxazole, an oxadiazole, a hydrazone and a pyrazoline.

7. A recording material as claimed in claim 3, wherein said photoconductor is an organic compound selected from the group consisting of an oxazole, an oxadiazole, a hydrazone and a pyrazoline.

8. A recording material as claimed in claim 7, wherein said photoconductor is 2,5-bis-(4'-diethylaminophenyl)-1,3,4-oxadiazole.

9. A recording material as claimed in claim 7, wherein said photoconductor is 2-vinyl-4-(2'-chlorophenyl)-5-(4'-diethylaminophenyl)-oxazole.

10. A recording material as claimed in claim 7, wherein said photoconductor is 2-phenyl-4-(2'-chlorophenyl)-5-(4'-diethylaminophenyl)-oxazole.

11. A recording material as claimed in claim 1, wherein said photoconductor is an inorganic compound.

12. A recording material as claimed in claim 4, wherein said photoconductors is an inorganic compound.

13. A recording material as claimed in claim 12, wherein said photoconductor is zinc oxide.

14. A recording material as claimed in claim 1, wherein said base material is a metal base or metallized film.

15. A recording material as claimed in claim 1, wherein said binder is soluble in an aqueous or alcoholic solvent.

16. A recording material as claimed in claim 15, wherein said binder comprises a styrene maleic anhydride copolymer or a phenolic resin.

17. A composition for sensitizing electrophotographic recording material, comprising an admixture of at least three sensitizing dyes, wherein at least two of said sensitizing dyes comprise cyanine compounds containing 3,3'-dimethylindolenine moieties at each end of the cyanine chain and having a sensitizing action in the red and green wavelength regions, respectively.

18. A composition as claimed in claim 17, wherein said two sensitizing dyes comprise a bis-(3,3'-dimethylindolenyl)-trimethinecyanine sensitizing dye and a bis-(3,3'-dimethylindolenyl)-pentamethinecyanine sensitizing dye, respectively.

19. A composition as claimed in claim 17, wherein a third dye of said sensitizing dyes comprises a cyanine dye selected from the group consisting of Astrazone Orange R (C.I. 48040), Astrazone Orange G (C.I. 48035), Astrazone Yellow 3G (C.I. 48055), Astrazone Yellow 5G (C.I. 48065) and Basic Yellow 52115 (C.I. 48060).

20. A composition as claimed in claim 17, wherein a third dye of said sensitizing dyes comprises a bis-benzoxazoltrimethinecyanine compound.

21. A composition as claimed in claim 17, wherein the remaining of said three sensitizing dyes has a sensitizing action in a wavelength region that differs from said red and green wavelength regions.

22. A composition as claimed in claim 21, wherein said remaining dye has a sensitizing action in the blue wavelength region.

23. A recording material as claimed in claim 1, wherein the remaining of said three sensitizing dyes has a sensitizing action in a wavelength region that differs from said red and green wavelength regions.

24. A recording material as claimed in claim 23, wherein said remaining dye has a sensitizing action in the blue wavelength region.

* * * * *